US008181425B2

(12) United States Patent
McCutcheon et al.

(10) Patent No.: US 8,181,425 B2
(45) Date of Patent: May 22, 2012

(54) APPARATUS FOR SEALING CAPSULES

(75) Inventors: Gabriel M. McCutcheon, Greenwood, SC (US); Gunther Van Goolen, Bornem (BE); Stefaan Jaak Vanquickenborne, Bornem (BE)

(73) Assignee: Capsugel Belgium, Bornem (BE)

( * ) Notice: Subject to any disclaimer, the term of this patent is extended or adjusted under 35 U.S.C. 154(b) by 0 days.

(21) Appl. No.: 12/376,219

(22) PCT Filed: Jul. 19, 2007

(86) PCT No.: PCT/IB2007/002101

§ 371 (c)(1),
(2), (4) Date: Jun. 22, 2009

(87) PCT Pub. No.: WO2008/015519

PCT Pub. Date: Feb. 7, 2008

(65) Prior Publication Data

US 2010/0018167 A1 Jan. 28, 2010

Related U.S. Application Data

(60) Provisional application No. 60/821,406, filed on Aug. 4, 2006.

(30) Foreign Application Priority Data

Aug. 11, 2006 (EP) ..... 06118804

(51) Int. Cl.
*B65B 51/02* (2006.01)
*B65B 51/10* (2006.01)
*A61J 3/07* (2006.01)

(52) U.S. Cl. ..... 53/329.2; 53/383.1; 53/900; 156/69

(58) Field of Classification Search ..... 53/900, 53/560, 281, 329, 329.2, 376.2, 383.1; 156/69, 156/423
See application file for complete search history.

(56) References Cited

U.S. PATENT DOCUMENTS

| | | | | |
|---|---|---|---|---|
| 3,025,652 | A * | 3/1962 | Sandhage et al. | 53/281 |
| 4,403,461 | A * | 9/1983 | Goutard et al. | 53/900 |
| 4,522,666 | A | 6/1985 | Wittwer | |
| 4,539,060 | A * | 9/1985 | Wittwer et al. | 156/69 |
| 4,656,066 | A * | 4/1987 | Wittwer | 156/69 |
| 4,724,019 | A * | 2/1988 | Brown et al. | 156/69 |

(Continued)

FOREIGN PATENT DOCUMENTS

DE 3246392 6/1984

(Continued)

*Primary Examiner* — Stephen F Gerrity
(74) *Attorney, Agent, or Firm* — Finnegan, Henderson, Farabow, Garrett & Dunner, LLP

(57) ABSTRACT

The present invention relates to a method and apparatus for sealing telescopically joined hard shell capsules. The method includes i. placing the capsule in a static sealing position in a capsule carrier assembly; ii. in the sealing position, applying a sealing fluid uniformly to the gap of the capsule; iii. rotating the capsule into a static suction position angularly spaced from the sealing position; and iv. in the suction position, providing an area of low pressure around the capsule so as to remove excess sealing liquid from the capsule. The apparatus includes a frame, a capsule carrier, a sealing device, and a suction device. The capsule carrier including a cavity configured to accommodate a capsule. The sealing device being configured apply a sealing fluid. The suction device being configured to provide an area of low pressure around a capsule in a cavity of the capsule carrier.

33 Claims, 3 Drawing Sheets

U.S. PATENT DOCUMENTS

| | | | | |
|---|---|---|---|---|
| 4,820,364 | A * | 4/1989 | Graham | 156/69 |
| 4,861,415 | A * | 8/1989 | Gamberini | 156/69 |
| 4,899,516 | A * | 2/1990 | Krieger et al. | 53/329 |
| RE33,251 | E * | 7/1990 | Wittwer et al. | 156/69 |
| 4,940,499 | A | 7/1990 | Lebrun et al. | 156/69 |
| 4,991,377 | A * | 2/1991 | Marchesini | 156/69 |
| 5,094,184 | A * | 3/1992 | Yamamoto et al. | 53/900 |
| 5,930,984 | A * | 8/1999 | Furuya et al. | 156/69 |
| 2004/0144066 | A1 * | 7/2004 | Piemontese | 53/900 |
| 2005/0110192 | A1 | 5/2005 | Cade et al. | 264/275 |
| 2005/0217207 | A1 * | 10/2005 | Konishi et al. | 53/560 |
| 2007/0036830 | A1 * | 2/2007 | Vanquickenborne et al. | 424/400 |
| 2008/0141621 | A1 * | 6/2008 | Funaro et al. | 53/281 |
| 2008/0236106 | A1 * | 10/2008 | Trebbi et al. | 53/281 |

FOREIGN PATENT DOCUMENTS

| | | |
|---|---|---|
| EP | 0110603 A2 | 6/1984 |
| EP | 1072245 | 1/2001 |
| EP | 1459725 | 9/2004 |
| SU | 1393309 | 4/1988 |

* cited by examiner

APPARATUS FOR SEALING CAPSULES

This application is a national stage application under 35 U.S.C. 371 of PCT/IB2007/002101, filed on Jul. 19, 2007, which claims the benefit of U.S. Patent Application No. 60/821,406, filed on Aug. 4, 2006 and European Patent Application Number 06118804.1, filed on Aug. 11, 2006.

The present invention relates to a method and apparatus for sealing telescopically joined hard shell capsules.

It is known to seal hard shell capsules by applying a sealing fluid, typically containing a solvent, to the capsule such that the sealing fluid flows into the circumferential gap formed between the coaxial, partly overlapping body parts, usually referred to as the body and the cap. Upon curing, a seal is then formed between the body and the cap.

EP 1 072 245 discloses a method and apparatus for sealing hard capsules. The capsules are placed on a rotating cylinder and transported by rotation from a loading position, wherein the capsules are fed on the cylinder and sealed, to an ejection position at a 120° interval. The capsules have a pre-determined amount of a sealing fluid applied to the area of overlap between the cap and the body via an annular manifold which includes an array of spray nozzles. The manifold also includes an array of holes connected to a vacuum manifold to remove some of the excess sealing liquid. As stated in EP 1 072 245, the capsules are still tacky at this stage and are transferred to a drying basket where they are dried whilst being tumbled and conveyed along a spiral path. The drying basket includes axial slits through which a high velocity airflow is introduced into the basket. This airflow is sufficient to lift the capsules away from the inner wall of the basket and it is said to enhance the tumbling action of the capsules and to minimise the capsule to basket contact time.

It is known to apply the vacuum during the 120°-rotation of the capsules from their loading position to their ejection position.

It has now been found that the quality of the seal can be improved by minimising the mechanical impacts to which the capsules are subjected during the sealing process. Thus, it is desired to allow the seal to cure with the minimum of mechanical disturbance.

According to a first aspect of the present invention, there is provided an apparatus for sealing a hardshell capsule having coaxial body parts which overlap when telescopically joined with each other, thereby forming a circumferential gap around the capsule, the apparatus comprising:

- a frame;
- a capsule carrier assembly rotatably mounted on the frame and provided with at least one cavity for accommodating a respective capsule therein;
- sealing means for applying a sealing fluid uniformly to the gap of a capsule to be sealed in the respective cavity;
- suction means adapted to provide an area of low pressure around the capsule in the respective cavity after application of the sealing fluid so as to remove excess sealing liquid from the capsule;
- driving means for driving the capsule carrier assembly in rotation; and
- control means for synchronously controlling the driving means, the sealing means and the suction means, said control means being adapted to stepwise rotate the capsule carrier assembly into successive static positions of the cavity, including a sealing position, wherein the capsule is sealed by the sealing means,
- wherein said static positions further include a suction position wherein the suction means are activated to provide an area of low pressure around the capsule in the respective cavity, said suction position being angularly spaced from the sealing position.

The provision of a static suction position substantially enhances the effect of the suction and thus improves the drying efficiency, since the sealing fluid, at least during a part of the suction time, is not submitted to inertial forces which disturb the distribution of the excess fluid on the capsule.

By having capsules which are substantially dry when entering the fusion station, it is not necessary to agitate and tumble the capsules to prevent them either sticking to each other or to the surfaces of the fusion station. Thus, the seal can be cured with the capsule being subjected to the minimum amount of mechanical impacts, resulting in a higher quality seal and fewer defective capsules.

An additional advantage of having an efficient vacuum (or suction) effect and an efficient vacuum source is that the capsule walls have improved physical characteristics. As is known, the presence of excess sealing fluid on the capsule wall can cause the physical properties of the capsule wall to begin to deteriorate. This can result in capsule walls which are more brittle, thinner, etc. By removing the excess sealing fluid as quickly and as efficiently as possible, this deterioration in the capsule walls can be minimised.

The present invention as defined above provides significant improvements over the known sealing apparatus. For example, the sealing apparatus described in EP 1 072 245 uses a less efficient vacuum system which provides a reduced pressure at the nozzle outlet of about 650 mbar, resulting in a drying efficiency of less than 1.1. Accordingly, the capsules entering the drying basket are not substantially dry and are required to be tumbled and agitated to prevent them sticking to each other or the sides of the basket. This in turn increases the chance of damaging the capsules and/or decreases the quality of the seal.

By contrast, the seals of capsules sealed using the present invention can be cured using conditions which are gentler and result in fewer mechanical impacts, thus providing higher quality seals.

The sealing fluid may form a seal between the body and the cap by causing the body and cap polymer materials to fuse together, e.g. by dissolving the polymer materials in the sealing fluid and then removing the sealing fluid, whereby the polymers fuse together; or it may form a separate discrete layer between the body and the cap, such as an adhesive layer.

Advantageously, the apparatus of the invention may have one or more of the following optional features:

- the suction position is angularly spaced of 90° from the sealing position;
- said static positions further include a loading position, wherein the cavity is loaded with a capsule to be sealed, the sealing position being angularly spaced from the loading position;
- the sealing position is angularly spaced of 90° from the loading position;
- the cavity has an axis corresponding to the axis of the capsule received therein which is vertical in the loading position and horizontal in the sealing position;
- said static positions further include an ejection position, wherein the capsule can be ejected from the cavity, the ejection position being angularly spaced from the suction position;
- the ejection position is angularly spaced of 90° from the suction position;
- the control means are adapted to activate the suction means to provide an area of low pressure around the capsule in the respective cavity as the capsule carrier assembly is rotated from the sealing position to the suction position and from the suction position to the ejection position;

the control means are adapted to activate the suction means for the capsule between the sealing position and the ejection position over a residence time period in the range of 0.2 to 2 seconds, preferably in the range of 1 to 1.5 second, more preferably equal to 1.33 second;

the suction means include a vacuum source, at least one vacuum nozzle communicating with the cavity and selectively connected to the vacuum source or isolated therefrom, the suction means being capable of providing a reduced pressure at the nozzle outlet of between 100 and 600 millibars, preferably between 250 and 350 millibars;

the drying efficiency calculated as [(1000/nozzle outlet pressure in mbar)×residence time in seconds] is at least 1.2;

the sealing means include a sealing fluid applicator comprising at least one spray nozzle communicating with the cavity and adapted to spray a predetermined volume of the sealing fluid to the gap;

the sealing fluid applicator comprises a plurality of nozzles circumferentially spaced around the cavity;

the suction means include a conduit connecting the vacuum nozzle to the vacuum source, said conduit having a vacuum source end and a nozzle end, wherein the cross sectional area of the conduit at the vacuum source end (A1) is 75 to 1300 $mm^2$; and the nozzle has a cross sectional area (A2) of 0.0075 to 0.3 $mm^2$, and wherein the ratio A1/A2 is 250 to 170,000;

the capsule carrier assembly includes a drum rotatably mounted on the frame and at least one process bar attached to the drum on the periphery thereof, said process bar comprising the cavity, the respective vacuum nozzle and the respective sealing fluid applicator;

the process bar includes a plurality of cavities each adapted to receive a respective capsule and each cavity is associated with a respective sealing fluid applicator and at least one respective vacuum nozzle;

the capsule carrier assembly comprises a plurality of process bars carried by the drum, which are arranged on the periphery thereof about the rotation axis so as to be angularly spaced one from the other with the same pitch angle;

the capsule carrier assembly comprises four process bars arranged about the rotation axis with a pitch angle equal to 90°;

the apparatus further includes a fusion station arranged to receive the capsule from the capsule carrier assembly, the fusion station including a fusion heat source and a transport arrangement capable of transporting the capsule from a first end to a second end of the fusion station;

the fusion station is arranged to receive the capsule from the capsule carrier assembly in the ejection position;

the transport arrangement includes a mesh basket and the fusion heat source comprises a flow of heated gas;

the mesh basket is a multi-stage basket including at least a first stage and a second stage and the basket is driven to rotate about a longitudinal axis;

a stage of the mesh basket comprises a frusto-conical internal wall which is arranged with its central axis being horizontal and the capsule is conveyed from smaller diameter end to the larger diameter end by the action of gravity;

a stage of the mesh basket is cylindrical and includes internal elements arranged to define a spiral path through the cylinder, whereby the capsule is transported from the first end of the stage to the second end by the screw action of the internal elements;

the first stage of the mesh basket comprises a frusto-conical internal wall which is arranged with its central axis being horizontal and the capsule is conveyed from smaller diameter end to the larger diameter end by the action of gravity, and the second stage of the mesh basket is cylindrical and is arranged to be coaxial with the first stage, the second stage including internal elements arranged to define a spiral path through the cylinder, whereby the capsule is transported from the first end of the second stage to the second end by the screw action of the internal elements; and the rotational speed of the basket is selected to provide a residence time for the capsule within the fusion station of between 20 and 100 seconds, preferably 30 to 70 seconds.

The ratio A1/A2 for the apparatus described in EP 1 072 245 is about 100. It has been found that a higher ratio of results in a more efficient vacuum system.

Preferably, the sealing fluid comprises a solvent. In this context, the term "solvent" is intended to mean a liquid within which the capsule polymer is soluble either at standard temperature and pressure or at elevated temperature and/or pressure. In particular, the polymer or polymer mix used to make the capsule body and cap should be soluble in the solvent at the operating temperature and pressure of the apparatus. The use of a solvent causes the polymer material of the body and cap to mix and fuse together during the removal of the solvent.

An advantage of the above-described arrangement is that the capsule can be transported very gently through the first part of the fusion station, which allows the initial curing of the seal to be completed with the minimum of mechanical disturbance or impact. This improves the quality of the seal. Once the seal is partly cured in the first stage of the fusion station, the capsule then enters the second stage, where the longitudinal speed of the capsule through the fusion station can be increased, for example.

In a yet further embodiment, the heat source is a heated gas, optionally heated air, and the flow is directed substantially perpendicular to the longitudinal axis of the basket(s). The air flow may be selected to be 5 to 20 m/s in order to provide a suitable flow rate.

The temperature of the heat source and the residence time of the capsule within the fusion zone are selected to provide the optimum seal integrity, whilst maintaining a satisfactory throughput of capsules.

According to a second aspect of the invention, there is provided a method for sealing a hardshell capsule having coaxial body parts which overlap. when telescopically joined with each other, thereby forming a circumferential gap around the capsule, the method comprising:

i. placing the capsule in a static sealing position in a capsule carrier assembly;

ii. in said sealing position, applying a sealing fluid uniformly to the gap of the capsule;

iii. rotating the capsule into a static suction position angularly spaced from the sealing position; and iv. in said suction position, providing an area of low pressure around the capsule so as to remove excess sealing liquid from the capsule.

Advantageously, the apparatus of the invention may have one or more of the following optional features:

the suction position is angularly spaced of 90° from the sealing position;

the capsule is loaded in a cavity in a static loading position and then rotated to its sealing position, the sealing position being preferably angularly spaced of 90° from the loading position;

the capsule is loaded in a vertical position and sealed in a horizontal position;

the capsule is rotated from the suction position into a static ejection position, which is preferably angularly spaced of 90° from the suction position, and then ejected from capsule carrier assembly;

an area of low pressure is provided around the capsule as the capsule is rotated from the sealing position to the suction position and from the suction position to the ejection position;

the low pressure around the capsule is provided over a residence time period between the sealing position and the ejection position in the range of 0.2 to 2 seconds, preferably in the range of 1 to 1.5 second, more preferably equal to 1.33 second;

the low pressure provided around the capsule is in the range of 100 to 600 millibars, preferably of 250 to 350 millibars;

the drying efficiency calculated as [(1000/low pressure in mbar)×residence time in seconds] is at least 1.2;

the method further comprises curing the seal formed by the sealing fluid in the gap by applying a fusion heat source while transporting the capsule from a first end to a second end of a fusion station; and the capsule is transported through at least a portion of the fusion station without tumbling or agitation.

The method as defined above relates to the use of an apparatus according to the first aspect of the invention. Accordingly, any feature(s) of the apparatus as defined hereinbefore may form an integer of the method.

As the capsules are substantially dry when entering the fusion station, they can be transported through the fusion station with the minimum of physical disturbances, as the likelihood of the capsules sticking to one another or to the internal surfaces of the fusion station are significantly reduced. Thus, the heat source and the manner by which the capsule is transported through the fusion zone can be selected to provide the optimum seal quality, rather than selected to achieve the best compromise between reducing the capsules sticking to each other or the internal surfaces and the achieving an adequate seal.

An embodiment of the invention will now be described in detail, by way of example only, and with reference to the accompanying drawings, in which.

Figure 1:
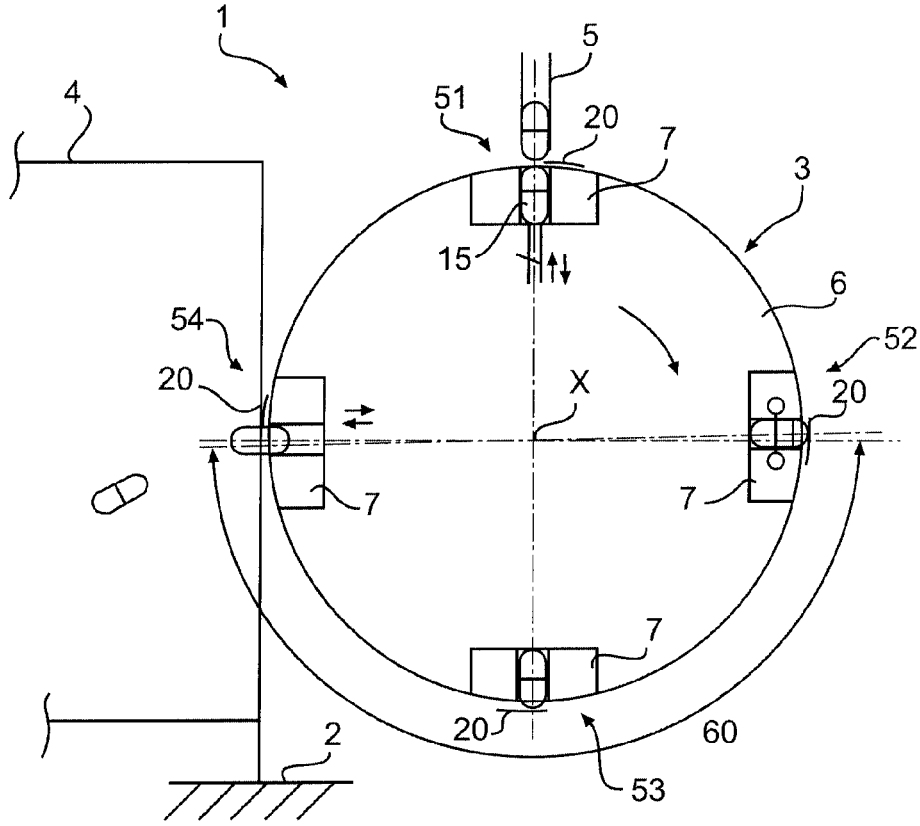
FIG. 1 is a schematic elevation view of an apparatus according to the invention, comprising four process bars carried on a drum which can rotate.

FIG. 1 shows an apparatus 1 according to the invention, essentially including a frame 2, a capsule carrier assembly 3 mounted on the frame 2 so as to be able to rotate about a rotation axis X, a fusion station 4 and a feeding conduit 5 provided to feed capsules into the capsule carrier. assembly 3.

In a normal use position, the apparatus is oriented such that the rotation axis X is substantially horizontal and the feeding tube 5 substantially vertical (or oriented so as to feed the capsules in a vertical position into the capsule carrier assembly 3).

The capsule carrier assembly 3 comprises a generally cylindrical drum 6 and four identical process bars 7 carried by and attached to the drum 6 on the periphery thereof. The process bars 7 are arranged in the same orientation and axial position on the drum 6 and are evenly distributed circumferentially about the rotation axis X of the carrier assembly 3. The process bars 7 are thus angularly spaced one from the other with a pitch angle of 90°. In alternative embodiments, the capsule carrier assembly 3 may comprise eight process bars with a pitch angle of 45°, for example.

The apparatus further comprises driving means (not shown) for driving the capsule carrier assembly 3 in rotation. One cycle of the carrier assembly 3 corresponds to a complete revolution 360° about the rotation axis X.

Figure 2:
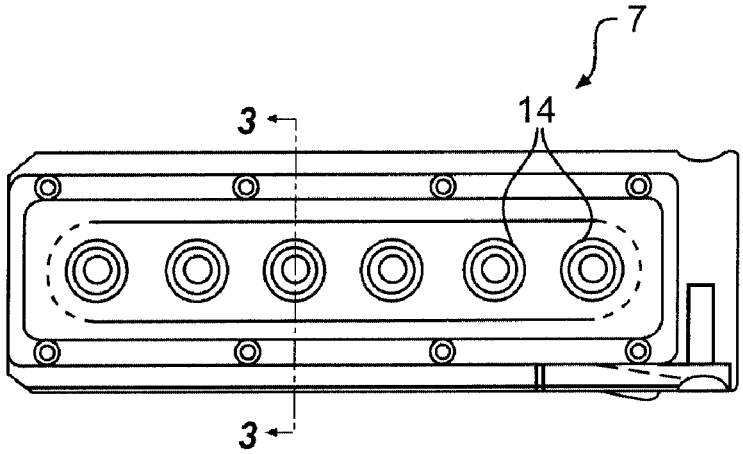
FIG. 2 is an enlarged top view of a process bar shown on FIG. 1.
Figure 3:
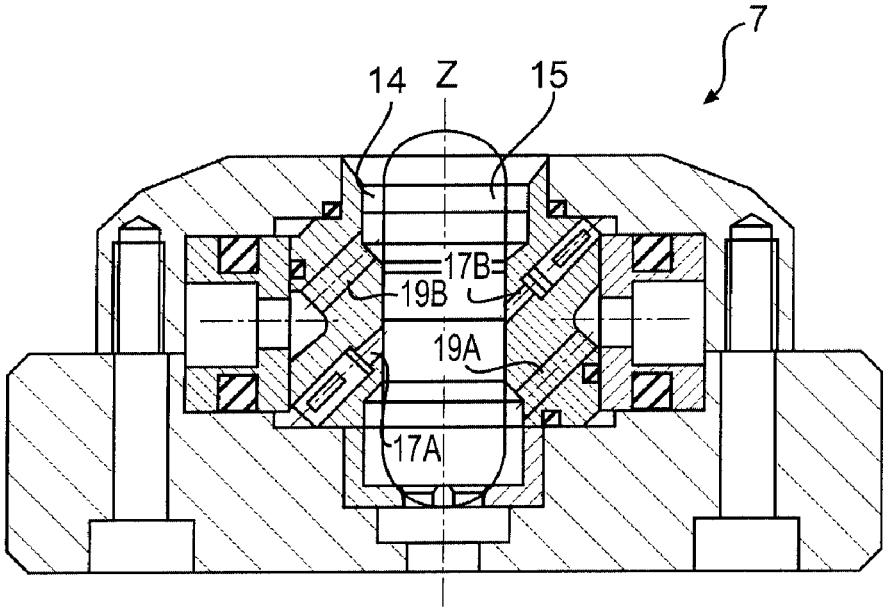
FIG. 3 is an enlarged cross-sectional view, in the plane 3-3, of the process bar of FIG. 2.

A process bar 7 is shown in more details on FIGS. 2 and 3. In the example shown, each process bar 7 has defined therein six cavities or cylinders 14 sized to receive therein respective capsules 15. The cavity has an axis Z corresponding to the longitudinal axis of the capsule 15 accommodated therein.

The capsules 15 are typically gelatine capsules comprising a body and a cap which are telescopically joined such that the cap circumferentially overlies a portion of the body to define a gap therebetween. This type of capsule is common in the art and will not be described in more detail herein.

The apparatus 1 further comprises sealing means for applying a sealing fluid uniformly to the gap of the capsule 15 in the respective cavity 14. These sealing means comprise, for each cavity, a sealing fluid applicator comprising a plurality of spray nozzles 17A, 17B communicating with the cavity 14 and adapted to spray a predetermined volume of the sealing fluid to the gap. The spray nozzles 17A, 17B are located within the wall of each cylinder 14 and circumferentially spaced about the Z-axis.

The spray nozzles 17A, 17B are connected to a reservoir (not shown) of a solvent, typically a 50:50 water/ethanol mix for gelatine capsules, and a pump (not shown) which is controlled to deliver a predetermined volume of the solvent from each spray nozzle 17A, 17B.

The apparatus 1 further comprises suction means adapted to provide an area of low pressure around the capsule 15 in the respective cavity 14 after application of the sealing fluid so as to remove excess sealing liquid from the capsule. The suction means include a vacuum source (not shown), a plurality of vacuum nozzles 19A, 19B communicating with the cavity 14 and selectively connected to the vacuum source or isolated therefrom, the suction means being capable of providing a reduced pressure at the nozzle outlet of between 100 and 600 millibars, preferably between 250 and 350 millibars. The vacuum nozzles 19A, 19B are circumferentially spaced about the Z-axis.

The vacuum source is capable of generating a vacuum pressure at its outlet of 100 to 600 mbar at a flow rate of 10 to 40 $m^3$ per hour. More preferably, the vacuum source is capable of generating a vacuum pressure at its outlet of 250 to 350 mbar at a flow rate of 20 to 30 $m^3$ per hour.

For example, there may be three circumferentially spaced spray nozzles 17A which are upwardly oriented at a first Z-axial position and three circumferentially spaced spray nozzles 17B which are downwardly oriented at a second Z-axial position spaced from the first position. There also may be two sets of circumferentially spaced vacuum nozzles 19A, 19B which are Z-axially spaced. The spray nozzles 17A, 17B are axially spaced from the vacuum nozzles 19A, 19B.

Each process bar 7 also includes a capsule retaining mechanism comprising a biased plate 20 (FIG. 1) which selectively closes each cylinder during the processing of the capsules to retain the capsules 15 within their respective cylinders 14 or opens each cylinder during the cycle of the capsule carrier assembly 3.

Figure 4:
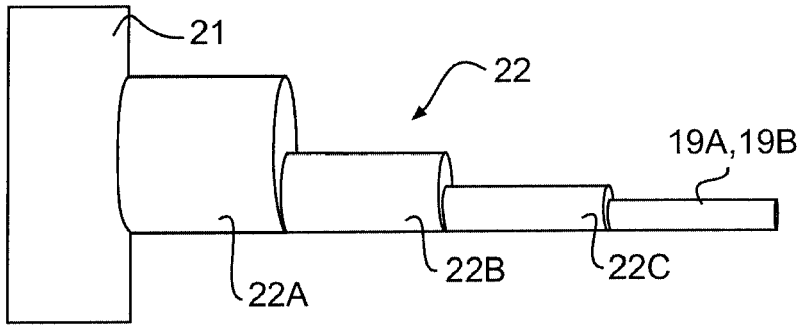
FIG. 4 is a schematic representation of the vacuum system of the apparatus of FIG. 1.

The vacuum nozzles 19A, 19B are connected to the vacuum source or vacuum pump 21 as shown schematically in FIG. 4. The vacuum pump 21 is a liquid ring pump which maintains a flow rate of 25 $Nm^3$ per hour at 200 mbar. The vacuum pump 21 is in fluid communication with the vacuum nozzles 19A, 19B via a conduit 22. As shown in FIG. 4, the diameter of the conduit 22 decreases at various intervals along its length providing a portion of the conduit 22*a* which has a first diameter D1, a second portion of the conduit 22*b* which has a second diameter D2, where D2 is smaller than D1, and a third portion of the conduit 22*c* which has a third diameter D3, where D3 is smaller than D2. The diameter D1 is 25 mm and the diameter of the nozzle is 0.2 or 0.3 mm. The diameters D2 and D3 can be chosen as convenient, provided that the conduit reduces in diameter from 25 mm to the diameter of the nozzle. Likewise the lengths of the conduit portions 22*a*, 22*b*, 22*c* can be varied according to convenience.

Figure 5:
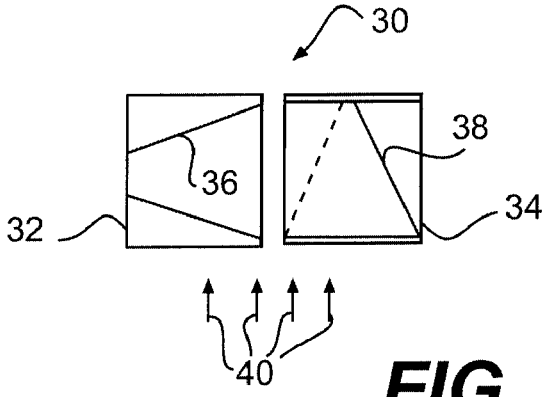
FIG. 5 is a longitudinal cross-sectional view through the first and second stages of the two-stage fusion basket of the apparatus of FIG. 1.

The fusion station 4 includes a two stage fusion basket 30 which is shown in FIG. 5. The fusion basket 30 consists of a first stage basket 32 which has an interior wall 36 defining a frusto-conical shape and a second stage basket 34 which is cylindrical in shape.

The second stage basket 34 includes internal elements 38 which define a helix within the basket 34.

The first and second stage baskets 32, 34 are formed from perforated steel to provide a mesh baskets through which air can flow.

The first stage basket 32 is arranged such that the longitudinal axis of the basket is horizontal and the end of the basket having the smaller diameter is located adjacent the capsule carrier assembly 3. The second stage basket 34 is also arranged such that its longitudinal axis is horizontal and is coaxial with the horizontal axis of the first basket 32. One end of the cylinder is located adjacent the end of the first stage basket 32 having the larger diameter. The internal diameter of the second basket is sized to match the internal diameter of first basket at its greatest point.

The first and second baskets 32, 34 are fixed to each other and include a common drive source (not shown) which drives the baskets to rotate about their longitudinal axes. Suitable rotational drive sources are well known and will not be described in detail herein.

The fusion station 4 further includes a flow of hot air (shown by arrows 40) which is directed through the fusion, basket 30 to heat the capsules and thereby cure the seal formed between capsule body and the cap. The temperature of the air and the flow rate can be selected according to the capsule material and the residence time of the capsule within the fusion basket 30. However, for a gelatine capsule with a typical residence time of 50 seconds within the fusion zone, the air is heated to a temperature of 50° C. and has a flow rate of 6 to 11 m/s.

The apparatus 1 further includes control means (not shown) for synchronously controlling the driving means, the sealing means and the suction means, said control means being adapted to stepwise rotate the capsule carrier assembly 3 into four successive static positions 51, 52, 53, 54 angularly spaced of 90°. In one cycle of rotation, over 360°, one process bar 7 is successively placed and temporarily stopped in these four static positions 51, 52, 53, 54, while the three other bars 7 of the carrier assembly 3 are correspondingly placed and temporarily stopped respectively in the three other static positions.

The control means may also include a manifold system able to selectively connect or isolate the vacuum nozzles 19A, 19B of a process bar 7 from the vacuum source, so as to activate the suction means for the cavities 14 of this bar 7, depending on the angular position of said bar in the cycle.

The control means are adapted to control the pump associated with the reservoir of sealing fluid, so as to activate the sealing means for the cavities 14 of one bar 7 depending on the angular position of said bar in the cycle.

Reference is now made again to FIG. 1 to describe in more details the operating mode of the apparatus.

In use, the first process bar 7 receives six capsules 15 from the feeding conduits 5 at the capsule infeed point 51 at the start of a cycle—reference angular position 0° angle—, corresponding to a loading position for the cavities 14 of this bar 7. Each capsule 15 is fed into its respective cylinder 14 within the process bar 7 and held in place in the process bar by the retaining mechanism during part of the cycle.

In this embodiment, the capsules 15 are not rectified prior to being fed into their respective cylinders 14 within the process bar 7. The rectification would consist in orienting all the capsules in the same way (e.g. body down and cap up). Indeed, the provision of both a set of spray nozzles 17A inclined upwards and a set of spray nozzles 17B inclined downwards makes the rectification useless since the gap may be effectively sprayed with sealing fluid from either one set of nozzles or the other. However, should the spray nozzles arrangement be different, a rectification step may be included prior to the capsules being fed into their respective cylinders, such that all of the capsules are oriented in the same way.

The process bar 7 is then rotated clockwise by rotation of the carrier assembly 3 to a second position 52 of the cycle—angular position: 90°—, corresponding to a sealing position for the cavities 14 of this bar 7, where the solvent is sprayed into the gap between the capsule body and cap via the spray nozzles 17A, 17B arranged around each capsule.

The rotation of the process bar 7 via the drum 6 is continued clockwise over 90° until a suction position 53—angular position: 180°—and the capsules 15 within the process bar 7 are aspirated via the vacuum nozzles 19A, 19B. The aspiration is maintained over the essential of the rotational movement of the carrier assembly 3 from the sealing position 52 to the suction position 53 and during the stop in the suction position 53.

The rotation of the process bar 7 via the drum 6 is continued clockwise over 90° until an ejection position 54—angular position: 270° wherein the capsules contained in this bar can be ejected from the carrier assembly 3 into the fusion station 4. The aspiration is maintained for the cavities 14 of this process bar 7 over the essential of the rotational movement of the carrier assembly 3 from the suction position 53 to the ejection position 54 and stopped as the process bar 7 reaches the ejection position 54, so that the capsules 15 contained in this bar can be ejected from the carrier assembly 3.

It will be appreciated that the suction or aspiration is maintained for a bar 7 over substantially half of the cycle, i.e. 180° of the rotation of the carrier assembly 3, from the sealing position 52 immediately after the end of the sealing step to the ejection position 54 immediately before the ejection, as shown by the arrow 60 in FIG. 1.

In time of aspiration, this half-cycle corresponds to a residence time period in the range of 0.2 to 2 seconds, preferably in the range of 1 to 1.5 second, more preferably equal to 1.33 second.

At the end of the aspiration period, the process bar 7 arrives at the ejection position 54, where the capsules are ejected from the bar 7 into the first basket 32 of the fusion basket 30.

The rotation of the first basket 32, coupled with its frusto-conical interior shape causes the capsules to be transported from the narrower diameter end of the basket to the wider diameter end of the basket, with the speed of travel along the basket being determined by the angle of the interior wall 36 and the speed of rotation. When the capsules reach the end of the first basket 32, they pass into the second basket 34, where they are caused to travel from one end to the other by the internal elements 38 defining the helical screw thread. In other words, they are transported by a screw action. Again the speed of travel of the capsules through the second basket is determined by the pitch of the helical screw thread and the speed of rotation.

All the time the capsules are within the fusion basket 30, they are being subjected to the flow of heated air 40, which causes the seal between cap and the body to be cured.

When the capsules reach the end of the second basket 34, they are transferred to a bulk storage container or are conveyed to a further step in the capsule forming process, such as printing or quality control checking.

The invention claimed is:

1. An apparatus for sealing a hardshell capsule having coaxial body parts which overlap when telescopically joined with each other, thereby forming a circumferential gap around the capsule, the apparatus comprising:

(a) a frame;

(b) a capsule carrier assembly rotatably mounted on the frame and provided with at least one cavity for accommodating a respective capsule therein;

(c) sealing means for applying a sealing fluid uniformly to the gap of a capsule to be sealed in the respective cavity;

(d) suction means adapted to provide an area of low pressure around the capsule in the respective cavity after application of the sealing fluid so as to remove excess sealing fluid from the capsule;

(e) driving means for driving the capsule carrier assembly in rotation; and (f) control means for synchronously controlling the driving means, the sealing means and the suction means, said control means being adapted to stepwise rotate the capsule carrier assembly into successive static positions of the cavity, including a sealing position, wherein the capsule is sealed by the sealing means, wherein said static positions further include a suction position wherein the suction means are activated to provide an area of low pressure around the capsule in the respective cavity, said suction position being angularly spaced from the sealing position.

2. The apparatus according to claim 1, wherein the suction position is angularly spaced of 90° from the sealing position.

3. The apparatus according to claim 1 or 2, wherein said static positions further include a loading position, wherein the cavity is loaded with a capsule to be sealed, the sealing position being angularly spaced from the loading position.

4. The apparatus according to claim 3, wherein the sealing position is angularly spaced of 90° from the loading position.

5. The apparatus according to claim 3, wherein the cavity has an axis corresponding to the axis of the capsule received therein which is vertical in the loading position and horizontal in the sealing position.

6. The apparatus according to claim 1 or 2, wherein said static positions further include an ejection position, wherein the capsule can be ejected from the cavity, the ejection position being angularly spaced from the suction position.

7. The apparatus according to claim 6, wherein the ejection position is angularly spaced of 90° from the suction position.

8. The apparatus according to claim 6, wherein the control means are adapted to activate the suction means to provide an area of low pressure around the capsule in the respective cavity as the capsule carrier assembly is rotated from the sealing position to the suction position and from the suction position to the ejection position.

9. The apparatus according to claim 6, wherein the control means are adapted to activate the suction means for the capsule between the sealing position and the ejection position over a residence time period in the range of 0.2 to 2 seconds.

10. The apparatus according to claim 9, wherein the control means are adapted to activate the suction means for the capsule between the sealing position and the ejection position over a residence time period in the range of 1 to 1.5 second.

11. The apparatus according to claim 9, wherein the control means are adapted to activate the suction means for the capsule between the sealing position and the ejection position over a residence time period equal to 1.33 second.

12. The apparatus according to claim 1, wherein the suction means include a vacuum source, at least one vacuum nozzle communicating with the cavity and selectively connected to the vacuum source or isolated therefrom, the suction means being capable of providing a reduced pressure at the nozzle outlet of between 100 and 600 millibars.

13. The apparatus according to claim 12, wherein the control means are adapted to activate the suction means for the capsule between the sealing position and the ejection position over a residence time period in the range of 0.2 to 2 seconds, and the drying efficiency calculated as ((1000/nozzle outlet pressure in mbar)×residence time in seconds) is at least 1.2.

14. The apparatus according to claim 13, wherein the control means are adapted to activate the suction means for the capsule between the sealing position and the ejection position over a residence time period in the range of 1 to 1.5 second.

15. The apparatus according to claim 13, wherein the control means are adapted to activate the suction means for the capsule between the sealing position and the ejection position over a residence time period equal to 1.33 second.

16. The apparatus according to claim 12, wherein the suction means include a conduit connecting the vacuum nozzle to the vacuum source, said conduit having a vacuum source end and a nozzle end, wherein the cross sectional area of the conduit at the vacuum source end is 75 to 1300 $mm^2$; and the nozzle has a cross sectional area of 0.0075 to 0.3 $mm^2$, and wherein the ratio of the vacuum source end and the nozzle cross sectional area is 250 to 170,000.

17. The apparatus according to claim 12, wherein the capsule carrier assembly includes a drum rotatably mounted on the frame and at least one process bar attached to the drum on the periphery thereof, said process bar comprising the cavity, a respective vacuum nozzle and a respective sealing fluid applicator.

18. The apparatus according to claim 17, wherein the process bar includes a plurality of cavities each adapted to receive a respective capsule and each cavity is associated with the respective sealing fluid applicator and at least one respective vacuum nozzle.

19. The apparatus according to claim 17, wherein the capsule carrier assembly comprises a plurality of process bars carried by the drum, which are arranged on the periphery thereof about the rotation axis so as to be angularly spaced one from the other with the same pitch angle.

20. The apparatus according to claim 19, wherein the capsule carrier assembly comprises four process bars arranged about the rotation axis with a pitch angle equal to 90°.

21. The apparatus according to claim 12, wherein the suction means is capable of providing a reduced pressure at the nozzle outlet of between 250 and 350 millibars.

22. The apparatus according to claim 1, wherein the sealing means include a sealing fluid applicator comprising at least one spray nozzle communicating with the cavity and adapted to spray a predetermined volume of the sealing fluid to the gap.

23. The apparatus according to claim 22, wherein the sealing fluid applicator comprises a plurality of nozzles circumferentially spaced around the cavity.

24. The apparatus according to claim 1, further including a fusion station arranged to receive the capsule from the capsule carrier assembly, the fusion station including a fusion heat source and a transport arrangement capable of transporting the capsule from a first end to a second end of the fusion station.

25. The apparatus according to claim 24, wherein the fusion station is arranged to receive the capsule from the capsule carrier assembly in an ejection position.

26. The apparatus according to claim 24, wherein the transport arrangement includes a mesh basket and the fusion heat source comprises a flow of heated gas.

27. The apparatus according to claim 26, wherein the mesh basket is a multi-stage basket including at least a first stage and a second stage and the basket is driven to rotate about a longitudinal axis.

28. The apparatus according to claim 27, wherein a stage of the mesh basket comprises a frusto-conical internal wall which is arranged with its central axis being horizontal and the capsule is conveyed from a smaller diameter end to a larger diameter end by the action of gravity.

29. The apparatus according to claim 27, wherein a stage of the mesh basket is cylindrical and includes internal elements arranged to define a spiral path through the cylinder, whereby the capsule is transported from the first end of the stage to the second end by the screw action of the internal elements.

30. The apparatus according to claim 27, wherein the first stage of the mesh basket comprises a frusto-conical internal wall which is arranged with its central axis being horizontal and the capsule is conveyed from a smaller diameter end to a larger diameter end by the action of gravity, and the second stage of the mesh basket is cylindrical and is arranged to be coaxial with the first stage, the second stage including internal elements arranged to define a spiral path through the cylinder, whereby the capsule is transported from the first end of the second stage to the second end by the screw action of the internal elements.

31. The apparatus according to claim 27, wherein the rotational speed of the basket is selected to provide a residence time for the capsule within the fusion station of between 20 and 100 seconds.

32. The apparatus according to claim 31, wherein the rotational speed of the basket is selected to provide a residence time for the capsule within the fusion station of between 30 to 70 seconds.

33. An apparatus for sealing a hardshell capsule having coaxial body parts which overlap when telescopically joined with each other, thereby forming a circumferential gap around the capsule, the apparatus comprising:

(a) a frame;

(b) a capsule carrier assembly rotatably mounted on the frame and provided with at least one cavity for accommodating a respective capsule therein;

(c) sealing means for applying a sealing fluid uniformly to the gap of a capsule to be sealed in the respective cavity;

(d) suction means adapted to provide an area of low pressure around the capsule in the respective cavity after application of the sealing fluid so as to remove excess sealing fluid from the capsule;

(e) driving means for driving the capsule carrier assembly in rotation; and (f) control means for synchronously controlling the driving means, the sealing means and the suction means, said control means being adapted to stepwise rotate the capsule carrier assembly into successive static positions of the cavity, including a sealing position, wherein the capsule is sealed by the sealing means, wherein said static positions further include a suction position wherein the suction means are activated to provide an area of low pressure around the capsule in the respective cavity, said suction position being angularly spaced 90° from the sealing position;

wherein the static positions further include a loading position, wherein the cavity is loaded with a capsule to be sealed, the sealing position being angularly spaced 90° from the loading position;

wherein the cavity has an axis corresponding to the axis of the capsule received therein which is vertical in the loading position and horizontal in the sealing position.

* * * * *

UNITED STATES PATENT AND TRADEMARK OFFICE

CERTIFICATE OF CORRECTION

PATENT NO. : 8,181,425 B2
APPLICATION NO. : 12/376219
DATED : May 22, 2012
INVENTOR(S) : Gabriel M. McCutcheon et al.

It is certified that error appears in the above-identified patent and that said Letters Patent is hereby corrected as shown below:

Title page, item 57, line 13, "configured apply a sealing liquid" should read -- configured to apply a sealing liquid --.

Claim 10, col. 10, line 16, "second" should read -- seconds --.

Claim 11, col. 10, line 20, "second" should read -- seconds --.

Claim 14, col. 10, line 36, "second" should read -- seconds --.

Claim 15, col. 10, line 40, "second" should read -- seconds --.

Signed and Sealed this
Eleventh Day of September, 2012

David J. Kappos

David J. Kappos
*Director of the United States Patent and Trademark Office*